US005618248A

United States Patent [19]

Huang

[11] Patent Number: 5,618,248

[45] Date of Patent: Apr. 8, 1997

[54] DOUBLE-ACTING HYDRAULIC CYLINDER FOR USE IN AN EXERCISING APPARATUS

[76] Inventor: Chen-tan Huang, 3F, No. 7-2, Alley 10, Kungyuan Rd., Hsinchuang City, Taipei Hsien, Taiwan

[21] Appl. No.: 697,189

[22] Filed: Aug. 20, 1996

[51] Int. Cl.[6] ..... A63B 21/008

[52] U.S. Cl. ..... 482/112; 482/111; 482/113

[58] Field of Search ..... 188/151 R, 361–363, 188/266; 482/92, 111–113, 51, 53, 58, 73

[56] References Cited

U.S. PATENT DOCUMENTS

| | | | |
|---|---|---|---|
| 4,801,139 | 1/1989 | Vanhoutte et al. | 482/112 |
| 5,011,142 | 4/1991 | Eckler | 482/113 |
| 5,397,287 | 3/1995 | Lindfors | 482/113 |

*Primary Examiner*—Jerome Donnelly
*Assistant Examiner*—Glenn E. Richman
*Attorney, Agent, or Firm*—William E. Pelton

[57] ABSTRACT

A double-acting hydraulic cylinder consists of a cylindrical body having an inner wall and an outer wall and a piston rod attached with a piston movably mounted within the inner wall and dividing a space within the inner wall into a rear chamber and a front chamber. A rear seat is mounted on a rear end of the body and defines a first bypass communicating a first space between the inner and outer walls with the rear chamber. A front seat is mounted on a front end of the body and defines a second bypass communicating the first space and the front chamber and a first control channel and a second control channel which communicate with each other at a common end by a communicating channel in communication with the first space. A sleeve is rotatably mounted on the piston rod and comprises a first passage in communication with the front chamber, a second passage in communication with first passage and the first control channel and a third passage in communication with the second control channel and a communicating tube which extends in the first space and communicates the third passage with the rear chamber.

10 Claims, 5 Drawing Sheets

DOUBLE-ACTING HYDRAULIC CYLINDER FOR USE IN AN EXERCISING APPARATUS

FIELD OF THE INVENTION

The present invention is related to a double-acting hydraulic cylinder, particularly to a double-acting hydraulic cylinder used in an exercising apparatus to provide a resistance to a user of the exercising apparatus.

BACKGROUND OF THE INVENTION

Double-acting hydraulic cylinders are now widely used in exercising apparatuses to provide a resistance to a user who is exerting a force on the cylinder thereby to strengthen his (her) muscles.

However, the conventional double-acting hydraulic cylinder used in an exercising apparatus has the following disadvantages.

Firstly, when a piston of the hydraulic cylinder is forced to move within the hydraulic cylinder from one side to another side, the side of the hydraulic cylinder from which the piston is moved away cannot be immediately supplied with hydraulic oil in the hydraulic cylinder; thus, when a user exerts a pulling force immediately following exerting a pushing force on the hydraulic cylinder, at the beginning of the pulling operation, he (she) will experience a period of operation in which there is substantially no resistance from the hydraulic cylinder, which causes the operation of the apparatus to be not smooth.

Secondly, since the resistance obtainable from the conventional hydraulic cylinder is constant, the versatility of the conventional hydraulic cylinder is limited. The resistance of the conventional hydraulic cylinder cannot be adjusted to meet the different requirements of different users; for example, an adult may require a heavy resistance and a youth may require a light resistance from the hydraulic cylinder.

The present invention therefore is aimed to provide an improved double-acting hydraulic cylinder used in an exercising apparatus to mitigate and/or obviate the aforementioned problems.

SUMMARY OF THE INVENTION

It is an objective of the present invention to provide a double-acting hydraulic cylinder wherein when a piston of the hydraulic cylinder is forced to move within the hydraulic cylinder from one side to another side, the side of the hydraulic cylinder from which the piston is moved away can be immediately supplied with hydraulic oil in the hydraulic cylinder Another object of the present invention is to provide a double-acting hydraulic cylinder wherein the resistance obtainable from the hydraulic cylinder is adjustable.

A further objective of the present invention is to provide a double-acting hydraulic cylinder wherein the resistance of the hydraulic cylinder can be adjusted by simply rotating a single control ring.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
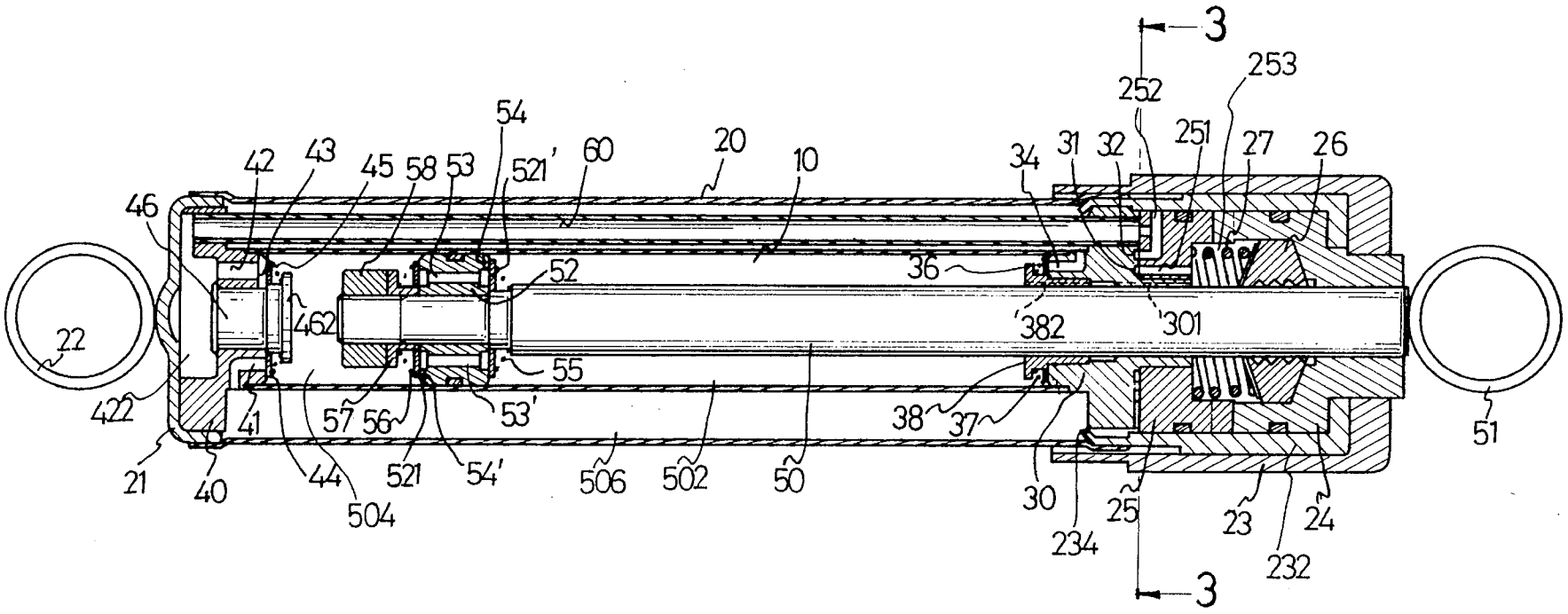
FIG. 1 is a cross-sectional view showing a double-acting hydraulic cylinder in accordance with a first embodiment of the present invention.
Figure 2:
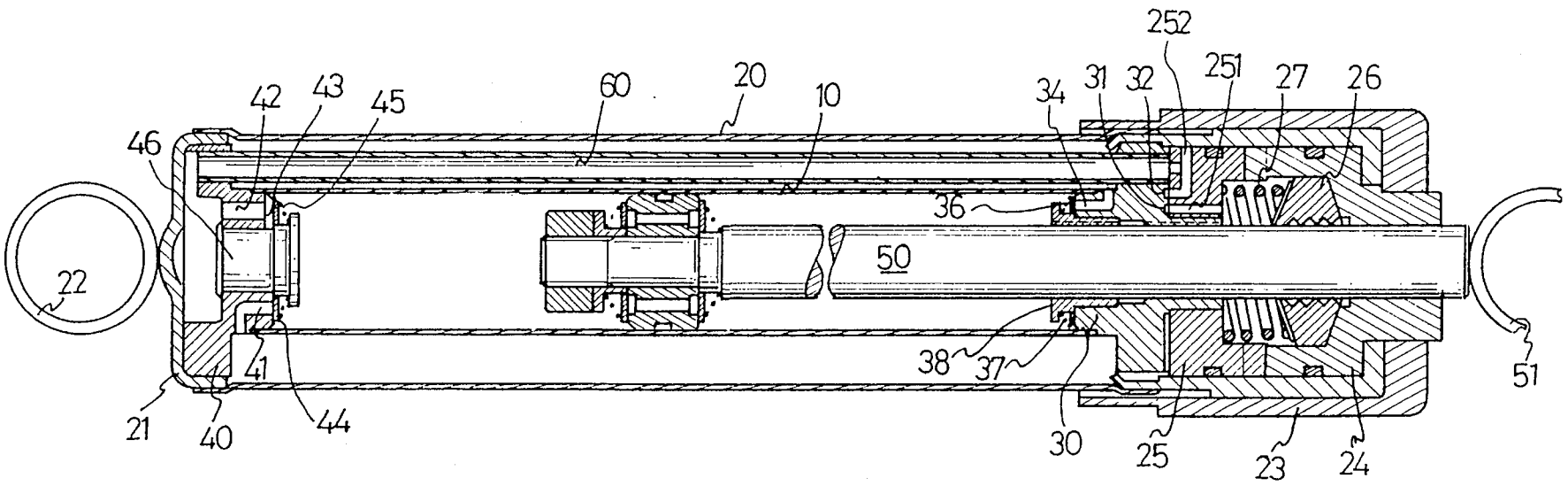
FIG. 2 is a view similar to FIG. 1 but showing that a piston of the hydraulic cylinder is pulled to the right a distance.

Refer to FIGS. 1 and 2 which show a first embodiment of a double-acting hydraulic cylinder in accordance with the present invention. The hydraulic cylinder is mounted on an exercising apparatus (not shown) to provide a resistance to a user of the exercising apparatus whereby the user's muscles may be strengthened.

The hydraulic cylinder generally consists of a cylindrical body defining an outer wall 20 and an inner wall 10, a communicating tube 60 extending between the outer wall 20 and the inner wall 10, a front seat 30 fixedly mounted on a front end of the body and a rear seat 40 fixedly mounted on a rear end of the body. A rear cap 21 is hermetically and fixedly mounted on the rear end of the body and houses a rear portion of the rear seat 40. A rear ring 22 is fixedly attached on the rear cap 21. The rear ring 22 is also fixedly connected to the exercising apparatus (not shown).

A piston rod 50 is slideably mounted in the inner wall 10. A front ring 51 fixedly attached on a front end of the piston rod 50. The front ring 51 is used to connect with a suitable means (not shown) for the user to grip so that the user can exert a pushing or pulling force on the hydraulic cylinder.

A piston 52 is fixedly mounted on a rear portion of the piston rod 50 and hermetically engages with the inner wall 10. The piston 52 divides an inner space of the inner wall 10 into a front chamber 502 and a rear chamber 504. An upper hole 53 and a lower hole 53' are respectively defined in an upper portion and a lower portion of the piston 52. The upper hole 53 has a front end communicating with the front chamber 502 via a first slit 54 and a rear end normally being closed by a first disk 521. The lower hole 53' has a front end normally being closed by a second disk 521' and a rear end communicating with the rear chamber 504 via a second slit 54'. A first spring 55 is mounted between the second disk 521' and the piston rod 50 to exert a pushing force on the second disk 521'. A second spring 56 is mounted between the first disk 521 and a first stop member 57 to exert a pushing force on the first disk 521. A nut 58 is threadedly engaged with a rear end of the piston rod 50 to fixedly mount the first stop member 57, the second spring 56, the first disk 521, the piston 52, the second disk 521' and the first spring 55 on the rear portion of the piston rod 50.

The rear seat 40 is formed to have an upper passage 42 communicating the communicating tube 60 with the rear chamber 504 via a first space 422 between the rear seat 40 and the rear cap 21 and a third slit 43. The rear seat 40 is also formed with a first L-shaped bypass 41 having a rear end in communication with a second space 506 defined between the outer wall 20 and the inner wall 10 and a front end normally closed by a third disk 44. A second stop member 46 is fixedly fitted in a central portion of the rear seat 40 and defines a front flanged end 462. The third disk 44 is mounted around the second stop member 46 and is pushed toward to the rear seat 40 by a third spring 45 compressed between the third disk 44 and the front flanged end 462 of the second stop member 46.

The front seat 30 is formed to have a second L-shaped bypass 34 having a front end in communication with the second space 506 and a rear end normally closed by a fourth disk 36. A third stop member 38 is fixedly mounted on a rear end of the front seat 30 and slideably engages with the piston rod 50. The fourth disk 36 is mounted around the third stop member 38 and is pushed toward the front seat 30 by a fourth spring 37 compressed between the fourth disk 36 and the third stop 38.

Figure 3:
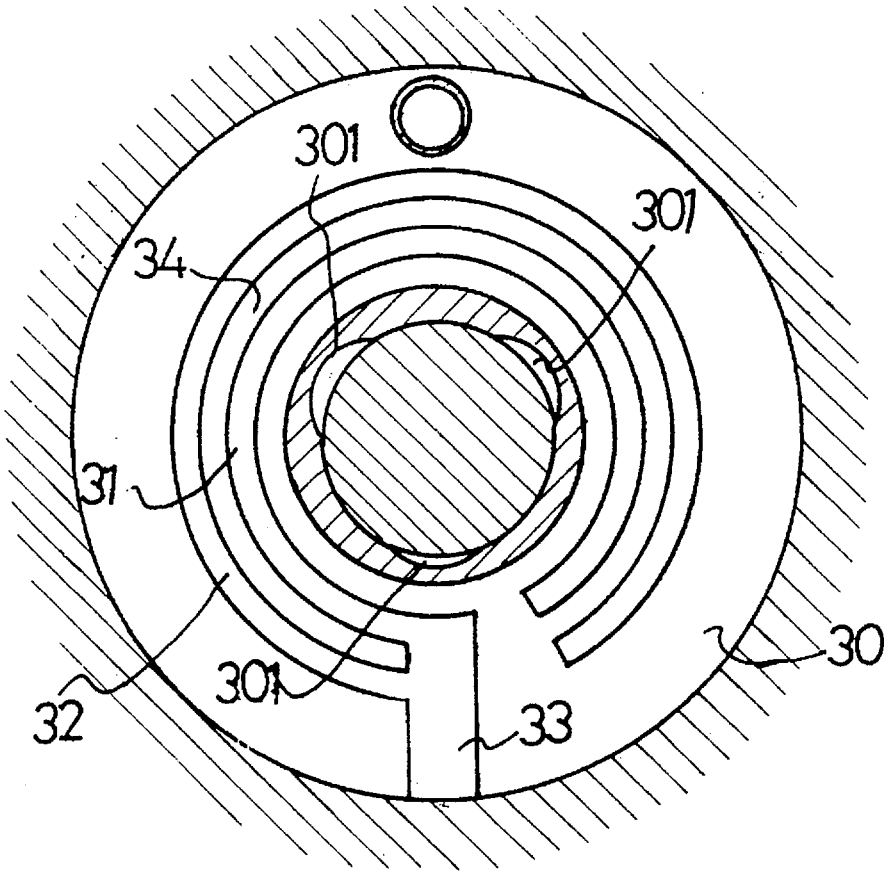
FIG. 3 is a cross-sectional view generally taken from line 3—3 of FIG. 1.

Also referring to FIG. 3, a first control channel 31, a second control channel 32 and a communicating channel 33 are defined on a rear end face of the front seat 30. The first and second control channels 31, 32 are communicated with the communicating channel 33 and each other at a common end thereof. At the portion other than the common end, the first and second control channels 31, 32 are separated from each other by a partition 34 formed by the front seat 30 and located between the two channels 31, 32. A plurality (three) of first communicating passages 301 are defined in an inner periphery of the front seat 30. The first communicating passages 301 are communicated with the front chamber 502 via a plurality (three) of second communicating passages 382 (FIG. 1) defined in an inner periphery of the third stop 36 and aligned with the first communicating passages 301.

Figure 4:
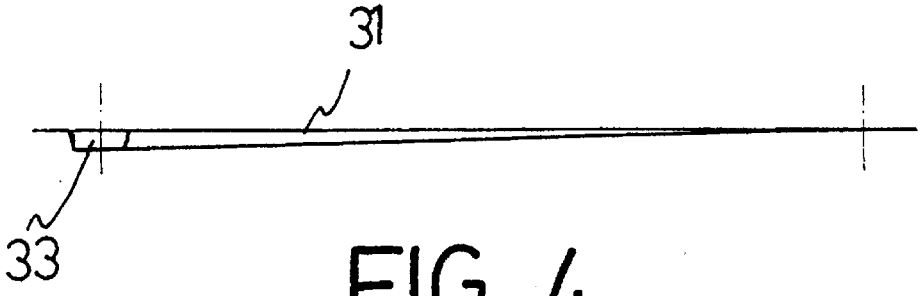
FIG. 4 is a diagrammatical view showing the change of depth along the length of a first control channel.

Also referring to FIG. 4, the first control channel 31 has a depth variable along a length thereof. The first control channel 31 has a depth gradually increasing from a distal end to the end near the communicating channel 33. The second control channel 32 has a similar configuration as the first control channel 31.

A first sleeve 25 is rotatably mounted on a rear end of the front seat 30 and defines a lower passage 251 in communication with the first control channel 31 and an upper passage 252 in communication with the communicating tube 60 and the second control channel 32.

A second sleeve 24 has a rear end fixedly connected with a rear end of the first sleeve 25 and a front end rotatably mounted the front end of the piston rod 50. When the second sleeve 24 is rotated, the first sleeve 25 rotates accordingly. A third space 253 is defined between the first sleeve 25 and the second sleeve 24. The third space 253 is in communication with the lower passage 251 defined by the first sleeve 25 and the communicating channel 301 defined by the front seat 30. A large seal 26 is mounted in the third space 253 and hermetically engages with the piston rod 50. A fifth spring 27 is compressed between the large seal 26 and the first sleeve 25.

A control ring 23 is fixedly mounted on a front end of the second sleeve 24 so that when the control ring 23 is rotated, the second sleeve 24 rotates accordingly. A mounting ring 232 is mounted between the control ring 23 and the first and second sleeves 25, 24 and has a rear end fixedly and hermetically engaging with a front end of the outer wall 20. A fourth slit 234 is defined between the mounting ring 232 and the front seat 30. The communicating channel 33 is communicated with the second space 506 via the fourth slit 234.

A small seal (not labeled) is respectively mounted on the first sleeve 25 and the second sleeve 24 to provide a hermetical engagement between the first and second sleeves 25, 24 and the mounting ring 232.

The following description is related to how the hydraulic cylinder in accordance with the present invention works.

The hydraulic cylinder is filled with oil. When the front ring 51 is pulled by a user to move toward the right of FIG. 1 to reach the position as shown by FIG. 2, a minor portion of the oil in the front chamber 502 will firstly flow backwardly through the first slit 54 and the upper hole 53 to open the first disk 521 to enter the rear chamber 504, thereby to facilitate the initial movement of the piston 52; otherwise, since the path for the oil in the front chamber 502 to flow into the rear chamber 504, which includes the second and first communicating passages 382 and 301, the lower and upper passages 251 and 252 defined by the first sleeve 25, the communicating tube 60, etc., is relatively long, an initial movement of the piston 52 may only compress the oil, which causes the initial movement of the piston 52 to become very difficult.

During the movement of the piston 52 toward the right, a major portion of the oil in the front chamber 502 will flow through the second communicating passages 381, the first communicating passages 301, the third space 253, the lower passage 251 defined by the first sleeve 25 to enter the first control channel 31 defined in the rear end face of the front seat 30. The oil entering the first control channel 31 will have a portion flowing through the second control channel 32, the communicating tube 60, the first space 422, the upper passage 42 of the rear seam 40 and the third slit 43 to enter the rear chamber 504 and a further portion flowing into the second space 506 defined between the inner wall 10 and the outer wall 20 via the communicating channel 33 and the fourth slit 234. The oil entering the second space 506 then will flow into the rear chamber 504 via the first L-shaped bypass 41.

Moreover, immediately after the piston 52 is moved to the right, a vacuum pressure will be created in the rear chamber 504. The vacuum pressure will induce the third disk 44 to leave the front end of the first L-shaped bypass 41 and the oil already existing in the second space 506 defined between the inner wall 10 and the outer wall 20 to immediately flow into the rear chamber 504.

Alternatively, when the piston 52 is pushed toward the left, a minor portion of the oil in the rear chamber 504 will flow forwardly through the second slit 54' and the lower hole 53' to open the second disk 521' to enter the front chamber 502 to facilitate the initial movement of the piston 52.

Moreover, immediately after the piston 52 is moved to the left, a vacuum pressure will be created in the front chamber 502. The vacuum pressure will induce the fourth disk 36 to leave the rear end of the second L-shaped bypass 34 and the oil in the second space 506 defined between the inner wall 10 and the outer wall 20 to immediately flow into the front chamber 502.

During the movement of the piston toward the left, a major portion of the oil in the rear chamber 504 will flow through the third slit 43, the upper passage 42 of the rear seat 40, the first space 422, the communicating tube 60, the upper passage 252 of the first sleeve 25 to enter the second control channel 32. The oil entering the second control channel 32 then will have a portion flowing into the second space 506 defined between the inner wall 10 and the outer wall 20 via the communicating channel 33 and the fourth slit 234, and a further portion flowing through the first control channel 31, the lower passage 251 of the first sleeve 25, the third space 253, the first communicating passages 301 of the rear seat 30 and the second communicating passages 382 of the third stop 38 to enter the front chamber 502.

No matter whether the piston 52 is moved to the left or the right, the chamber 504 or 502 can be immediately supplied with the hydraulic oil in the second space 506 defined between the inner wall 10 and the outer wall 20 via the bypass 41 or 34; thus, the hydraulic cylinder in accordance with the present invention can enable a user thereof to very smoothly operate the exercising apparatus.

Furthermore, by rotating the control ring 23 to rotate the first sleeve 25 via the second sleeve 24 to change the position of the lower and upper passages 251 and 252 of the first sleeve 25 relative to the first and second control channels 31 and 32 of the front seat 30, the cross-sectional area of the channel by which the oil can flow from the rear chamber 504 to the front chamber 502 or vice versa can be changed, the counter-pressure of the hydraulic oil acting on the piston 52 when the piston 52 is forced to move can be changed; thus, the resistance of the hydraulic cylinder in accordance with the present invention can be adjusted by simply rotating a single control ring.

Figure 5:
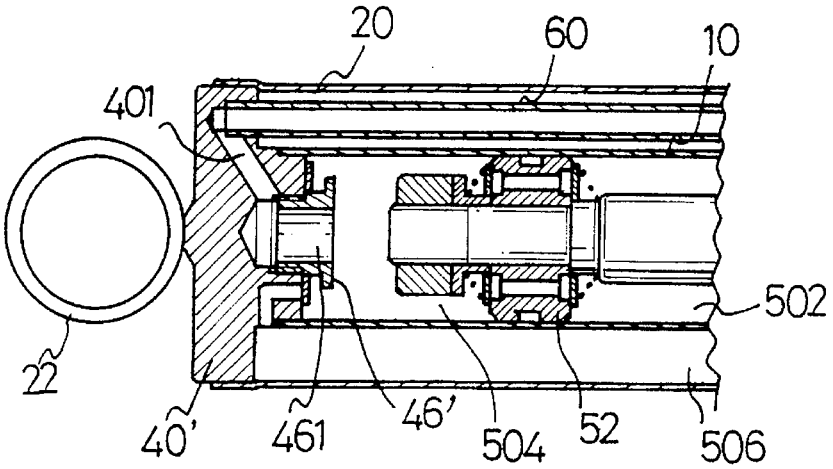
FIG. 5 is a cross-sectional view showing the details of a rear portion of a second embodiment of a double-acting hydraulic cylinder in accordance with the present invention.

FIG. 5 shows the details of a rear portion of a second embodiment in accordance the present invention. In this embodiment, a second stop member 46' is formed to have a central hole 461. A rear seat 40' is fixedly and hermetically mounted on the rear end of the cylindrical body defining the outer wall 20 and the inner wall 10. The rear ring 22 is directly fixedly attached to the rear seat 40' An inclined passage 401 is defined in the rear seat 40' to communicate the communicating tube 60 with the rear chamber 504 via the central hole 461. The third slit 43, the upper passage 42 defined in the rear seat 40, the rear cap 21 and the first space 422 of the first embodiment are no longer necessary in the second embodiment.

Figure 7:
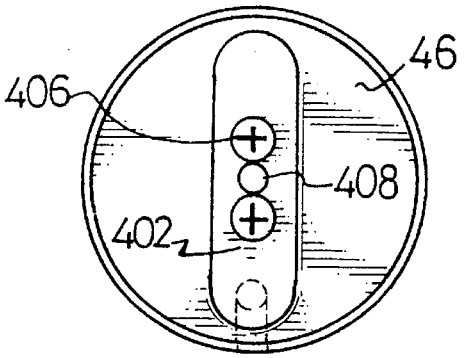
FIG. 7 is a right side view of FIG. 6.
Figure 6:
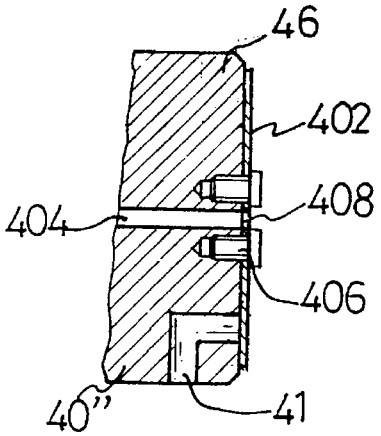
FIG. 6 is an enlarged cross-sectional view showing the details of a part of a rear seat attached with an elongate plate in accordance with a third embodiment of the present invention.

FIGS. 6 and 7 show the details of a part of a rear seat 40" attached with an elongate plate 402 in accordance with a third embodiment of the present invention. Like the rear seat 40' of the second embodiment, the rear seat 40" in accordance with the third embodiment is also fixedly and hermetically mounted on the rear end of the cylindrical body defining the outer and the inner walls 20, 10. However, in the third embodiment, the second stop 46' of the second embodiment is no longer necessary. Instead, a central hole 404 is extended from a front end face of the rear seat 40" and communicates with the communicating tube 60. The elongate plate 402 is attached on the front end face of the rear seat 40" by extending two screws 406 into the rear seat 40" through the elongate plate 402. A central bore 408 is defined in the elongate plate 402 and aligns with the central hole 404 of the rear seat 40". The elongate plate 402 has a lower portion normally closing a front end of the first bypass 41. When the piston 52 is moved to the right, the oil in the front chamber 502 will flow via the central hole 404 of the rear seat 40" and the central bore 408 of the elongate plate 402 to enter the rear chamber 504. Moreover, when the piston 52 is moved to the right, a vacuum pressure will be created in the rear chamber 504. The vacuum pressure will induce the lower portion of the elongate plate 402 to leave the front end of the first L-shaped bypass 41 and the oil already existing in the second space 506 defined between the inner wall 10 and the outer wall 20 to immediately flow into the rear chamber 504.

Figure 8:
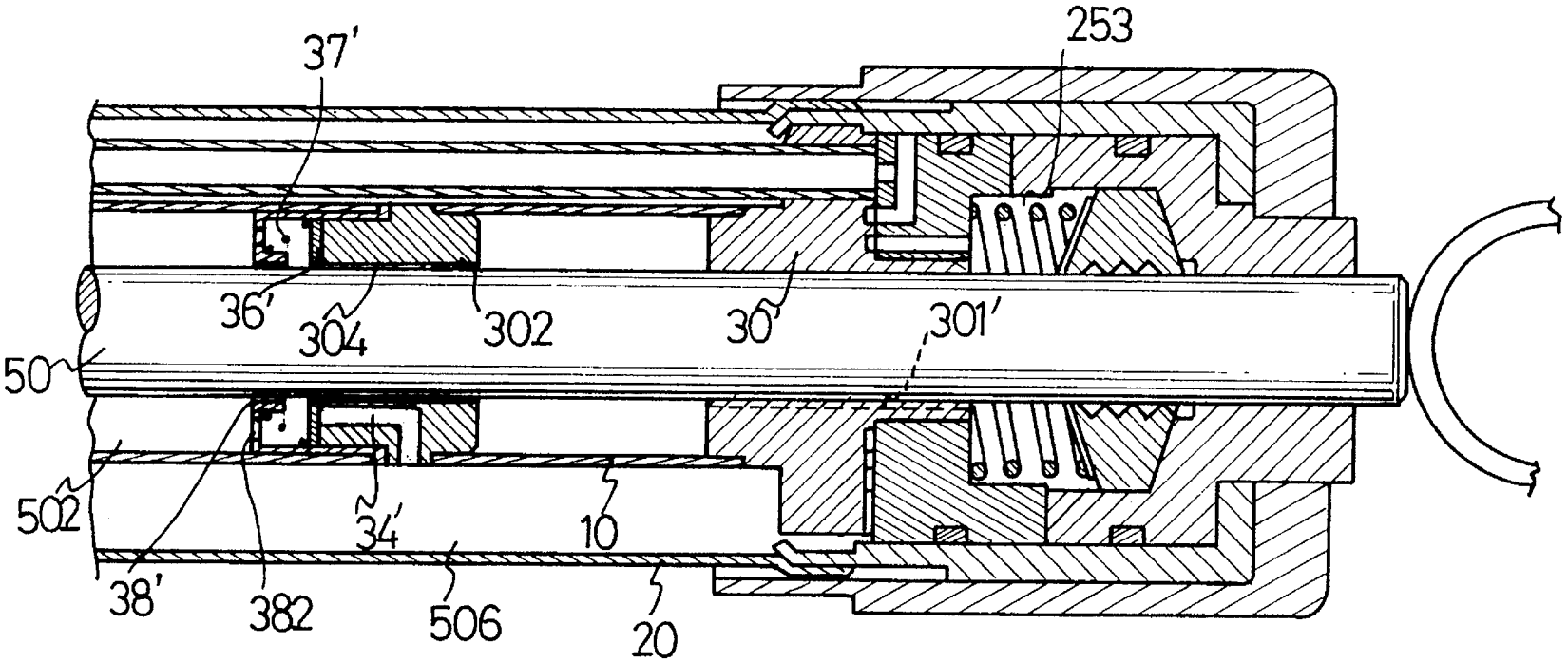
FIG. 8 is a view similar to FIG. 1 but showing a front portion of a fourth embodiment of a double-acting hydraulic cylinder in accordance with the present invention.

FIG. 8 shows a front portion of a fourth embodiment of a double-acting hydraulic cylinder in accordance with the present invention. The rear portion of the fourth embodiment has a structure the same as the that of the rear portion of the first embodiment as shown by FIG. 1.

In the fourth embodiment, a front seat 30' is fixedly mounted on a front end of the cylindrical body constituted by the inner wall 10 and the outer wall 20. The front seat 30' defines a plurality of first passages 301' extending therethrough and located neighboring the piston rod 50. A block 302 which defines an L-shaped bypass 34' is mounted between the piston rod 50 and the inner wall 10. The L-shaped bypass 34' communicates the second space 506 defined between the inner and outer walls 10 and 20 with the front chamber 502. The block 302 is located a distance behind the front seat 30'. The block 302 defines a plurality of second passages 304 extending therethrough and located neighboring the piston rod 50. A cup-shaped stop member 38' is mounted between the inner wall 10 and the piston rod 50 and located a distance behind the block 302. The stop member 38' has a front end clamped between the inner wall 10 and the block 302 and defines a plurality of holes 382 on a rear side thereof. A disk 36' is mounted around the piston rod 50 and located between the block 302 and the stop member 38'. A spring 37' is compressed between the stop member 38' and the disk 36' to push the disk 36' toward the L-shaped bypass 34' and thus the L-shaped bypass 34' is normally closed by the disk 36'.

When the piston rod 50 is pulled to the right in FIG. 8, oil in the front chamber 502 can flow to the third space 253 via the holes 382, the second passages 304 and the first passages 301'. When the piston rod 50 is pushed to the left in FIG. 8, a vacuum pressure will be created in the front chamber 502. The vacuum pressure will induce the disk 36' to leave the L-shaped bypass 34' and the oil in the second space 506 defined between the inner wall 10 and the outer wall 20 to immediately flow into the front chamber 502 via the L-shaped bypass 34' and the holes 382.

Since in this embodiment, the L-shaped bypass 34' is located nearer a center of the hydraulic cylinder, when the piston rod 50 is pushed to the left in the drawings, oil in the second space 506 defined between the inner wall 10 and the outer wall 20 can more quickly flow into the front chamber 502 via the L-shaped bypass 34'.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A double-acting hydraulic cylinder for use in an exercising apparatus to provide a resistance to a user thereof, comprising:

a cylindrical body comprising an outer wall and an inner wall and defining a front end and a rear end;

a piston rod extending into an inner space of the inner wall and attached with a piston to divide the inner space into a front chamber and a rear chamber;

a communicating tube extending between the outer and inner walls;

a rear seat mounted on the rear end of the cylindrical body and adapted to be fixedly attached to an exercising apparatus, comprising a first passage communicating the communicating tube with the rear chamber and a first bypass communicating a space defined between the outer and inner walls with the rear chamber;

a first blocking member provided in-the rear chamber for normally closing the first bypass, said first blocking member opening the first bypass when the piston is forced to move toward the front end;

a front seat mounted on the front end of the cylindrical body and defining a second passage in communication with the front chamber and a second bypass for communicating the space between the inner and outer walls with the front chamber and a first control channel and a second control channel, said first and second control channels respectively having a variable depth along their lengths and communicating with each other at a common end by a communicating channel, said communicating channel communicating with the space defined between the inner and outer walls;

a second blocking member provided in the front chamber for normally closing the second bypass, said second blocking member opening the second bypass when the piston is forced to moved toward the rear end;

a sleeve rotatably mounted around the piston rod and located at a front of the front seat, said sleeve defining a third passage in communication with the second passage and the first control channel and a fourth passage in communication with the second control channel and the communicating tube;

a control ring fixedly mounted on the sleeve so that when the control ring is rotated, the sleeve rotates accordingly; and a mounting ring mounted between the sleeve and the control ring, said mounting ring having a rear end hermetically and fixedly connected with a front end of the outer wall and an inner periphery hermetically engaging with the sleeve.

2. The double-acting hydraulic cylinder in accordance with claim 1, wherein the sleeve comprises a first sleeve member and a second sleeve member fixedly connected with each other and defining a first space therebetween, said first sleeve member defining the third and fourth passages, said second sleeve member being fixedly connected to the control ring, a seal being mounted in the first space and hermetically engaging the piston rod and a spring being compressed between the first sleeve member and the seal.

3. The double-acting hydraulic cylinder in accordance with claim 1, wherein the second passage being defined in an inner periphery of the front seat.

4. The double-acting hydraulic cylinder in accordance with claim 1, wherein the piston is formed to have a first hole and a second hole extending to communicate the front chamber with the rear chamber and said hydraulic cylinder further comprises a third blocking member provided in the rear chamber for normally closing the first hole and a fourth blocking member provided in the front chamber for normally closing the second hole, said third blocking member opening the first hole when the piston is forced to move toward the front end of the body, said fourth blocking member opening the second hole when the piston is forced to move toward the rear end of the body.

5. The double-acting hydraulic cylinder in accordance with claim 1, wherein said rear seat further comprises a rear cap to house the rear seat and said rear seat and rear cap define a second space therebetween, said second space communicating the first passage in the rear seat with the communicating tube.

6. The double-acting hydraulic cylinder in accordance with claim 1, wherein the first blocking member is a disk, said disk being pushed to close the first bypass by a spring force.

7. The double-acting hydraulic cylinder in accordance with claim 6, wherein the rear seat comprises a stop member defining a central hole in communication with the rear chamber, a spring being compressed between the disk and the stop member, the first passage of the rear seat communicating the communicating tube with the central hole.

8. The double-acting hydraulic cylinder in accordance with claim 1, wherein the first blocking member is an elongate plate fixedly attached to the rear seat by at least one fixing point, said elongate plate having a lower portion spaced from the fixing point and normally closing the first bypass.

9. The double-acting hydraulic cylinder in accordance with claim 8, wherein the elongate plate has a bore in alignment with the first passage of the rear seat.

10. A double-acting hydraulic cylinder for use in an exercising apparatus to provide a resistance to a user thereof, comprising:

a cylindrical body comprising an outer wall and an inner wall and defining a front end and a rear end;

a piston rod extending into an inner space of the inner wall and attached with a piston to divide the inner space into a front chamber and a rear chamber;

a communicating tube extending between the outer and inner walls;

a rear seat mounted on the rear end of the cylindrical body and adapted to be fixedly attached to an exercising apparatus, comprising a first communicating passage communicating the communicating tube with the rear chamber and a first bypass communicating a space defined between the outer and inner walls with the rear chamber;

a first blocking member provided in the rear chamber for normally closing the first bypass, said first blocking member opening the first bypass when the piston is forced to move toward the front end;

a front seat mounted on the front end of the cylindrical body and defining a plurality of first passages extending therethrough and a first control channel and a second control channel, said first and second control channels respectively having a variable depth along their lengths and communicating with each other at a common end by a communicating channel, said communicating channel communicating with the space defined between the inner and outer walls;

a block mounted between the inner wall and the piston rod and located a distance behind the front seat, said block defining a plurality of second passages extending therethrough and communicating with the front chamber and the first passages in the front seat and a second L-shaped bypass communicating the space defined between the inner and outer walls with the front chamber;

a cup-shaped stop member mounted between the inner wall and the piston rod and located a distance behind the block, said stop member having a front end clamped between the block and the inner wall and defining a plurality of holes on a rear side thereof;

a second blocking member provided in the front chamber and located between the stop member and the block;

a spring compressed between the second blocking member and the stop member to push the second blocking member toward the second L-shaped bypass and thus the second L-shaped bypass being normally closed by the second blocking member, said second blocking member opening the second bypass when the piston is forced to moved toward the rear end;

a sleeve rotatably mounted around the piston rod and located at a front of the front seat, said sleeve defining a second communicating passage in communication with the first passages in the front seat and the first control channel and a third communicating passage in communication with the second control channel and the communicating tube;

a control ring fixedly mounted on the sleeve so that when the control ring is rotated, the sleeve rotates accordingly; and a mounting ring mounted between the sleeve and the control ring, said mounting ring having a rear end hermetically and fixedly connected with a front end of the outer wall and an inner periphery hermetically engaging with the sleeve.

* * * * *